US006619610B1

(12) United States Patent
Genovese

(10) Patent No.: US 6,619,610 B1
(45) Date of Patent: Sep. 16, 2003

(54) PORTABLE ANCHORING BOOT

(76) Inventor: Nicholas Genovese, 346 Amber St., Staten Island, NY (US) 10306

( * ) Notice: Subject to any disclaimer, the term of this patent is extended or adjusted under 35 U.S.C. 154(b) by 0 days.

(21) Appl. No.: 10/198,312

(22) Filed: Jul. 18, 2002

(51) Int. Cl.[7] ..... F16M 13/00

(52) U.S. Cl. ..... 248/519; 248/346.2; 248/910; 135/118

(58) Field of Search ..... 248/346.2, 519, 248/523, 910; 135/111, 118, 140, 141, 144; 52/163, 165; 160/46, 53, 127

(56) References Cited

U.S. PATENT DOCUMENTS

| | | | | | |
|---|---|---|---|---|---|
| 3,794,279 | A | * | 2/1974 | Kramer | 248/523 |
| 4,174,107 | A | | 11/1979 | Hickey | 273/29 A |
| 4,648,482 | A | | 3/1987 | Kitson | 182/108 |
| 4,924,893 | A | | 5/1990 | Furey | 133/16 |
| 5,145,153 | A | | 9/1992 | Glynn | 256/59 |
| 5,188,314 | A | | 2/1993 | Peters | 244/31 |
| 5,259,612 | A | | 11/1993 | Matherne et al. | 273/1.5 R |
| 5,427,346 | A | | 6/1995 | Urgola | 248/519 |
| 5,452,877 | A | | 9/1995 | Riffle et al. | 248/511 |
| 5,592,896 | A | | 1/1997 | Cassidy | 114/303 |
| 5,685,517 | A | * | 11/1997 | Salibra | 248/519 |
| 5,758,856 | A | * | 6/1998 | Carnahan et al. | 248/523 |
| 5,823,898 | A | * | 10/1998 | Wang | 473/483 |

* cited by examiner

*Primary Examiner*—Ramon O. Ramirez
*Assistant Examiner*—Jon Szumny
(74) *Attorney, Agent, or Firm*—Michael I. Kroll

(57) ABSTRACT

A portable anchoring device 10 having a receiving sleeve 24 which is a cylindrical elongated tube having a throughbore 16 therein. The receiving sleeve 24 houses a filling chamber 30, filling cap 20, and the securing ring 28. The filling chamber 30 provides the means by which the portable anchoring device 10 may add more stability to its anchoring function and is equipped with an inlet cap 20 and an outlet cap 36. The retaining ring 28 is located at the base end 22 of the receiving sleeve 24 and provides the portable anchoring device with the means for securing a plurality of portable anchoring devices to each other. The retaining ring 28 also provides the means for securing a tent pole or gazebo leg 14 to the portable anchoring device. The base support element 22 is composed of two, semi-circle shaped units that provide the portable anchoring device with its foundation and anchorage support. The base support element 22 also houses the emptying cap 36 with emptying orifice 34 and a portion of the filling chamber 30. Also the base support element 22 provides the portable anchoring device with stability when the filling chamber 30 is filled or empty.

13 Claims, 9 Drawing Sheets

PORTABLE ANCHORING BOOT

BACKGROUND OF THE INVENTION

1. Field of the Invention

The present invention relates generally to portable anchoring devices and, more specifically, to a portable anchoring devices for gazebos, freestanding tents and any other suitable freestanding tent like structures. The present invention is a portable anchoring device having selective filling means. The portable anchoring device consists of a receiving sleeve element, a base support element, a filling chamber, a filling cap with filling orifice, an emptying cap with emptying orifice, and a retaining ring. The receiving sleeve is a cylindrical elongated tube having a circle shaped receiving aperture that extends to both distal ends. The receiving sleeve houses the filling chamber, filling cap, and the bungee loop. The receiving sleeve provides the means for the portable anchoring device to secure a tent pole or gazebo leg therein via the receiving aperture. The filling chamber provides the means for which said portable anchoring device may add more stability to its anchoring function. The filling chamber is a cylindrically shaped hollow structure that is encased in the receiving sleeve that is able to retain ballast substances or materials in order to add weight to its entity. The filling chamber is encompassed by both the receiving sleeve and the base support element. The filling cap provides the means for which the filling chamber of said portable anchoring device may be filled via the filling orifice. The emptying cap provides the means by which the filling chamber of said anchoring device may be emptied via the emptying orifice. The filling cap is located at the zenith end while the emptying cap is located at the base end of said portable anchoring device. The retaining ring is located at the distal end of the receiving sleeve that is opposite the filling cap, and provides said portable anchoring device with the means for securing a plurality of portable anchoring devices to each other. The retaining ring also provides the means for securing a tent pole or gazebo leg to said portable anchoring device. The base support element is composed of two semi-circle shaped units that provide said portable anchoring device with its foundation and anchorage support. The base support element also houses the emptying cap with emptying orifice and a portion of the filling chamber. Also the base support element provides said portable anchoring device with stability with the filling chamber filled or empty.

2. Description of the Prior Art

There are other portable anchoring devices designed for anchoring, and laying support for freestanding items. Typical of these is U.S. Pat. No. 4,174,107 issued to Hickey on Nov. 13, 1979.

Another patent was issued to Kitson on Mar. 10, 1987 as U.S. Pat. No. 4,648,482. Yet another U.S. Pat. No. 4,924,893 was issued to Furey on May 15, 1990 and still yet another was issued on Sep. 8, 1992 to Glynn as U.S. Pat. No. 5,145,153.

Another patent was issued to Peters on Feb. 23, 1993 as U.S. Pat. No. 5,188,314. Yet another U.S. Pat. No. 5,259,612 was issued to Matherne et al. on Nov. 9, 1993. Another was issued to Riffle et al. on Sep. 26, 1995 as U.S. Pat. No. 5,452,877 and still yet another was issued on Jun. 27, 1995 to Urgola as U.S. Pat. No. 5,427,346. Yet another U.S. Pat. No. 5,592,896 was issued to Cassidy on Jan. 14, 1997.

U.S. Pat. No. 4,174,107

Inventor: Robert B. Hickey

Issued: Nov. 13, 1979

A tennis practice device which uses a hollow container which may be fill with sand or water as an anchor for a tennis ball attached to the lid of the container by means of an elongated elastic line. The line is attached to the tennis ball by means of a nylon adapter line, which is threaded through the ball and tied in a loop. The elastic line is attached to the lid by means of a swivel hook. The device provides a completely portable tennis practice apparatus which may be filled with a weighty material during use and which serves as a storage container for the tennis ball and lines when it is not in use.

U.S. Pat. No. 4,648,482

Inventor: Michael J. Kitson

Issued: Mar. 10, 1987

The present invention relates to a ladder anchor for stabilizing a ladder while in use. The ladder anchor comprises a hollow member having at least a wedge shaped front portion provided with a closable orifice for filling the member with ballast or discharging ballast therefrom, the member having a ground engaging surface and top surface, the top surface having therein at least one recess for receiving one or each of the longitudinal struts of a ladder and providing a foot receiving surface between the recess or recesses and the base of the member. Preferably, the member can be filled with water as the ballast.

U.S. Pat. No. 4,924,893

Inventor: Charles Furey

Issued: May 15,1990

A beach umbrella anchoring system comprises as anchor member comprising a container, in the form of a beach bag, for containing a weighting medium, such as sand, and a connector for connecting the container to a beach umbrella restraining device; and a beach umbrella restraining device comprising of a flexible cable member, a releasable connector fixed to one end of the cable for releasably connecting the cable to a beach umbrella, a second releasable connector, fixed to the other end of the cable, for releasably connecting the cable member to the connector of the anchor member, and a third releasable connector, slidingly attached to the cable member intermediate the ends thereof for releasably attaching the cable member to the beach umbrella The anchoring system may be supplied in the form of a kit comprising the anchoring member (beach bag) the restraining device and a sand shovel for filling the container member with sand. The provision of the container member in the form of a beach bag allows the system to be readily carried to the beach along with other paraphernalia. The system serves to anchor beach umbrellas against being overturned and flailing about in sudden or unexpected gusts of wind.

U.S. Pat. No. 5,145,153

Inventor: William Glynn

Issued: Sep. 8, 1992

A modular portable handrail system employs cantilever arm/counter-weight anchor assemblies. Bases attach to opposing ends of the cantilever arms. A pail-like receptacle is receivable on one of the bases and interlockable with the base. The receptacle is filled with water, sand, or other material to provide the counter-weight mass.

U.S. Pat. No. 5,188,314

Inventor: William H. Peters

Issued: Feb. 23, 1993

The subject device is a balloon weight and holding device having and storing a balloon tether means and adapted to be attached to a balloon and functioning to prevent a balloon filled with a lighter-than-air gas from rising above a given tethered length, such devices comprising in general a spool member having a central cylindrical shaft flanked on each end by opposing circular plate members, each such plate having a circumferential rim. The spool member has the balloon tether wrapped around it to be unraveled at will. Integrally disposed between the inner face of such circular plate members are integrally affixed means to retard the process of unraveling of the balloon string so that the balloon string and thus the balloon do not become beyond the control of the person holding the balloon. An additional function of the subject device is such that if the balloon escapes the clutches of the holder, the balloon weight device will function as an anchor hold-down in order to prevent the balloon rising uncontrollably into the atmosphere.

U.S. Pat. No. 5,259,612

Inventor: Lonney R. Matherne

Issued: Nov. 9, 1993

A portable water-filled device for supporting a basketball system including a base configured to hold a ballast material for supporting the basketball system in a substantially rigid position during use of the system to play the game of basketball. A pole is pivotally mounted to the base such that the pole may move between a generally vertical position and a tilted position with the base configured with a beveled hole for restraining the pole from pivotal movement substantially beyond the tilted position. A contractible sleeve is utilized to pivotally attach support arms to the pole. The sleeve includes an adjustment wheel for securing the sleeve to the pole and a bubble level for vertically positioning the pole. The base is configured with an orifice through which water my be inserted into the base. A plug for closing the orifice includes an anchor for loosely connecting the plug to the base when the plug is disengaged from the orifice.

U.S. Pat. No. 5,452,877

Inventor: Mary A. Riffle

Issued: Sep. 26, 1995

A beach umbrella anchor bag is filled with a loose weighted material (i.e., sand or the like) and secured about the shaft of a beach umbrella to secure the umbrella in place against movement due to wind or other causes. The bag includes a relatively small bottom opening, allowing the shaft to be passed therethrough to penetrate the underlying surface for greater security. The bottom opening may be closed with a flap secured there over, so the bag may be used for the carriage of other articles when not anchoring an umbrella or the like. The upper portion of the bag includes umbrella shaft attachment panels therein, which secure to the umbrella shaft to prevent relative movement therebetween, and the top opening of the bag includes a draw string to secure the mouth of the bag around the shaft to prevent spillage of material from the bag. The attachment panels may comprise hook and loop fastening material such as Velcro (™), and cooperating flaps are provided within the bag to seal the inner panels against the intrusion of foreign matter when they are not secured to the umbrella shaft, and to preclude their attachment to articles carried in the bag. The bag may be formed of any suitable sheet of flexible material, such as Nylon (™) taffeta or other suitable durable material.

U.S. Pat. No. 5,427,346

Inventor: Mark Urgola

Issued: Jun. 27, 1995

A carrying case and anchoring system for a beach umbrella and its support shaft is disclosed comprising in combination:

(1) Container means consisting of top, bottom and side member wherein the top and bottom member are operationally connected at one edge by hinge means to allow pivoting of the member about the axis of the hinge means whereby the container is opened and closed; wherein the top, bottom and side member define a hollow cavity when the carrying case is closed of sufficient size to receive a beach umbrella, its support shaft and a weighting system for anchoring the container means, umbrella and support shaft; the top and bottom members being further characterized by possessing a plurality of paired openings situated through the bottom members wherein the openings of each pair are in direct opposition to one another such that when the carrying case is closed, the opening in the top member is juxtaposed upon the opening in the bottom member, thereby forming a channel through which the umbrella support shaft may be inserted;

(2) Locking means to secure the umbrella support shaft to the container means when it is closed and the support shaft is situated within the channel formed by the paired openings in the top and bottom members; and, (3) Weighting means which is placed within the container means hollow cavity to anchor the container means, beach umbrella and support shaft from wind forces.

In one embodiment, there are a plurality of openings, one pair forming a channel perpendicular to the top and bottom members of the container means, while another pair form a channel which is at an acute angle to the top and bottom members, thereby permitting the umbrella to adopt a variety of positions relative to the sun. In yet another embodiment of the invention, the locking means are contained within a hollow cylindrical sleeve which is inserted into the channel formed by the paired openings, the sleeve being flanged at one end to rest on the beach sand and open at the other end. The sleeve protrudes above the surface of the top member of the container means when it is closed. The umbrella support shaft is placed into the sleeve and locked into position by way of the locking means.

U.S. Pat. No. 5,592,896

Inventor: Francis J. Cassidy

Issued: Jan. 14, 1997

An assembleable anchor-type landscaping device which is lightweight, durable, and capable of being moved and shipped with minimal expense. The anchor device comprises a detachable connected ring, a hollow shank which is formed in multiple portions which are removably connected, a hollow removable stock, hollow and removable arms, and detachable fluke members (optionally hollow). The anchor may be variably filled with a ballast material to achieve appropriate landscaping weight.

While these portable anchoring devices may be suitable for the purposes for which they were designed, they would not be as suitable for the purposes of the present invention, as hereinafter described.

SUMMARY OF THE PRESENT INVENTION

The present invention discloses a portable anchoring device having a receiving sleeve which is a cylindrical elongated tube having a throughbore therein. The receiving sleeve houses a filling chamber, filling cap, and the securing ring. The filling chamber provides the means by which the portable anchoring device may add more stability to its anchoring function and is equipped with an inlet cap and an outlet cap. The retaining ring is located at the base end of the receiving sleeve and provides the portable anchoring device with the means for securing a plurality of portable anchoring devices to each other. The retaining ring also provides the means for securing a tent pole or gazebo leg to the portable anchoring device. The base support element is composed of two, semi-circle shaped units that provide the portable anchoring device with its foundation and anchorage support. The base support element also houses the emptying cap with emptying orifice and a portion of the filling chamber. Also the base support element provides the portable anchoring device with stability when the filling chamber is filled or empty.

The present invention overcomes the shortcomings of the prior art by providing a portable anchoring having selective filling means.

A primary object of the present invention is to provide a portable anchoring devices for gazebos, free standing tents and any other suitable freestanding tent like structures.

Another object of the present invention is to provide a portable anchoring devices that may be utilized on a plurality of surfaces.

Yet another object of the present invention is to provide a portable anchoring devices that may need no anchoring cables or devices like such, in order to be deemed anchored.

Still yet another object of the present invention is to provide a portable anchoring devices that is highly mobile.

Yet another object of the present invention is to provide a portable anchoring devices that may be filled with a ballast material for more stability.

Another object of the present invention is to provide a portable anchoring devices that may be one molded piece with all its part therein.

Additional objects of the present invention will appear as the description proceeds.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
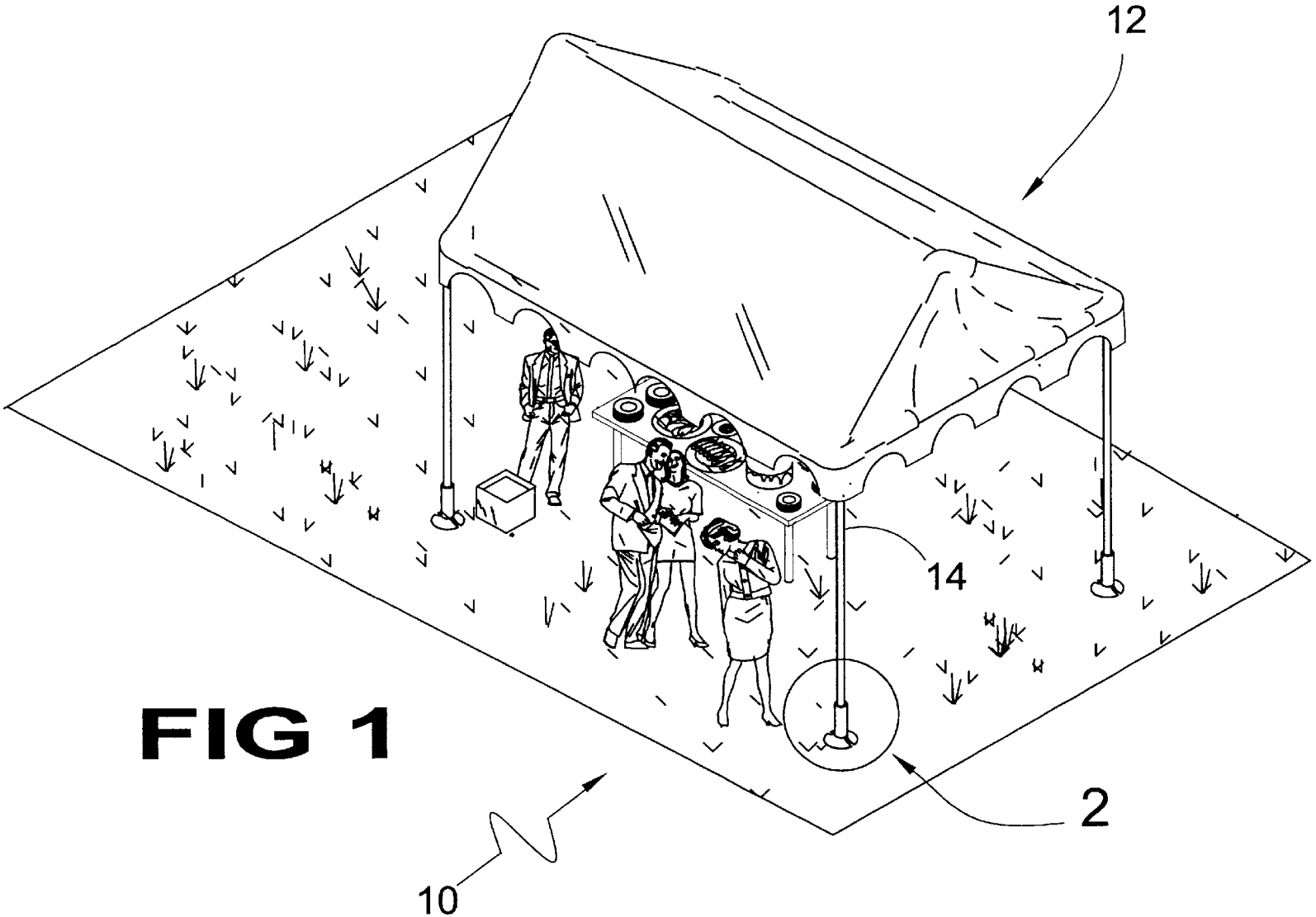
FIG. 1 is a perspective view of the present invention in use.

With regard to reference numerals used, the following numbering is used throughout the drawings.

10 present invention
12 tent
14 stanchion
16 throughbore
18 filling part
20 filling cap
22 base
24 receiving sleeve
26 securing cord
28 retaining ring
30 chamber
32 ballast material
34 outlet aperture
36 outlet aperture cap
38 groove
40 center

DETAILED DESCRIPTION OF THE PREFERRED EMBODIMENT(S)

In order that the invention may be more fully understood, it will now be described, by way of example, with reference to the accompanying drawings in which FIGS. 1 through 9 illustrate the present invention being a portable anchoring boot.

Turning to FIG. 1, shown therein is the present invention 10 in use. The present invention 10 is an anchoring device for free standing structures 12 such as a tent. The devices have a centrally disposed throughbore whereby a stanchion 14 of the free standing structure 12 can be inserted therein. The anchoring device is substantially hollow with an ingress aperture and egress aperture with selective sealing means in the form of threaded fasteners which provides for the filling of the cavity with a ballast material through the ingress aperture and the selective removal of the ballast through the egress aperture. Additionally the anchoring device has a hook element positioned on the base whereby the stanchion can be secured with a securing line such as a bungee cord.

Figure 2:
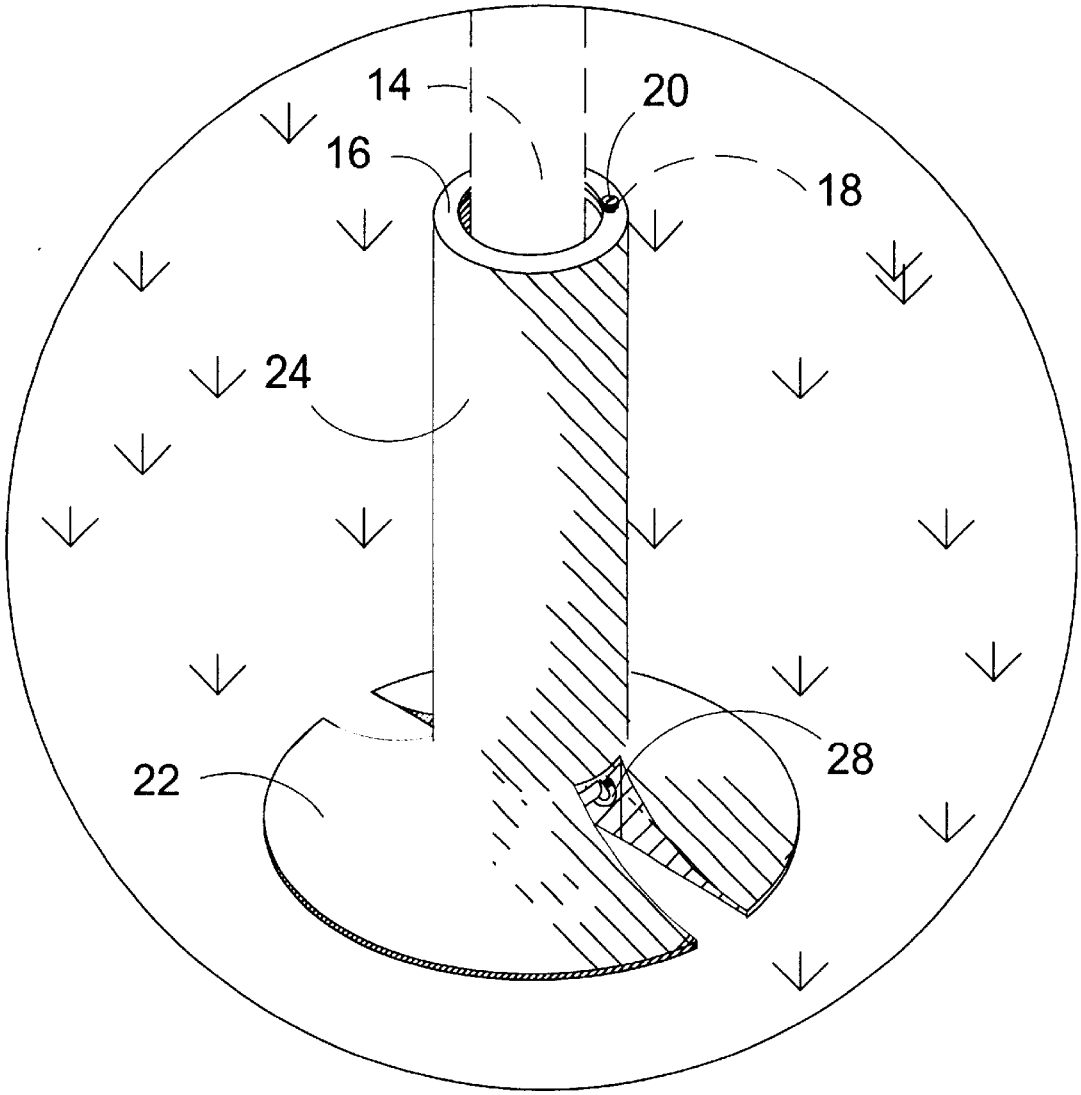
FIG. 2 is a perspective view of the present invention.

Turning to FIG. 2, shown therein is a perspective view of the present invention 10. Shown is the present invention having a stanchion 14 of a free standing tent or the like inserted into the central throughbore 16. The anchoring device has a receiving sleeve 24 having a centrally disposed throughbore 16 with openings on each end thereof whereby a stanchion 14 of a free standing structure can be inserted. The wall of the anchoring device is substantially hollow with a filling port 18 with filling cap 20 whereby a ballast material can be selectively inserted. Additionally the anchoring device has a retaining ring or hook element 28 positioned on the base support 22 whereby a securing line such as a bungee cord can be secured.

Figure 3:
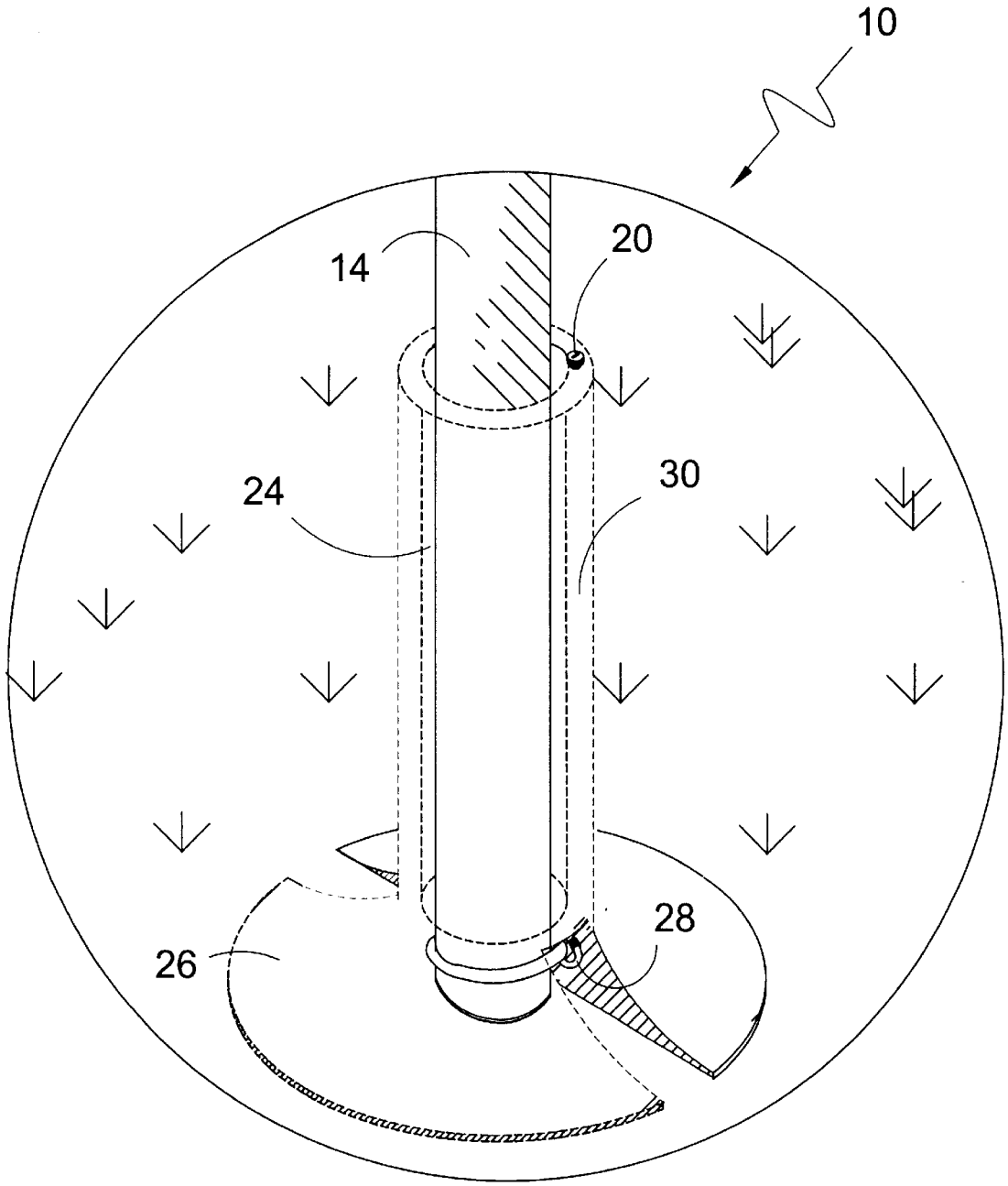
FIG. 3 is the present invention in partial outline with a securing cord.

Turning to FIG. 3, shown therein is the present invention 10 shown in partial outline with a securing cord 26, e.g., a bungee cord. Shown is the present invention in outline having a stanchion 14 from a free standing structure inserted therein the receiving sleeve 24 having a securing cord 26 wrapped around the stanchion end and hooked onto the retaining ring 28. The securing cord 26 can be of any length extending around or through the free standing structure 14 and secured to the retaining ring 28. Also shown is a filling chamber 30 internal the receiving sleeve 24 along with inlet cap 20.

Figure 4:
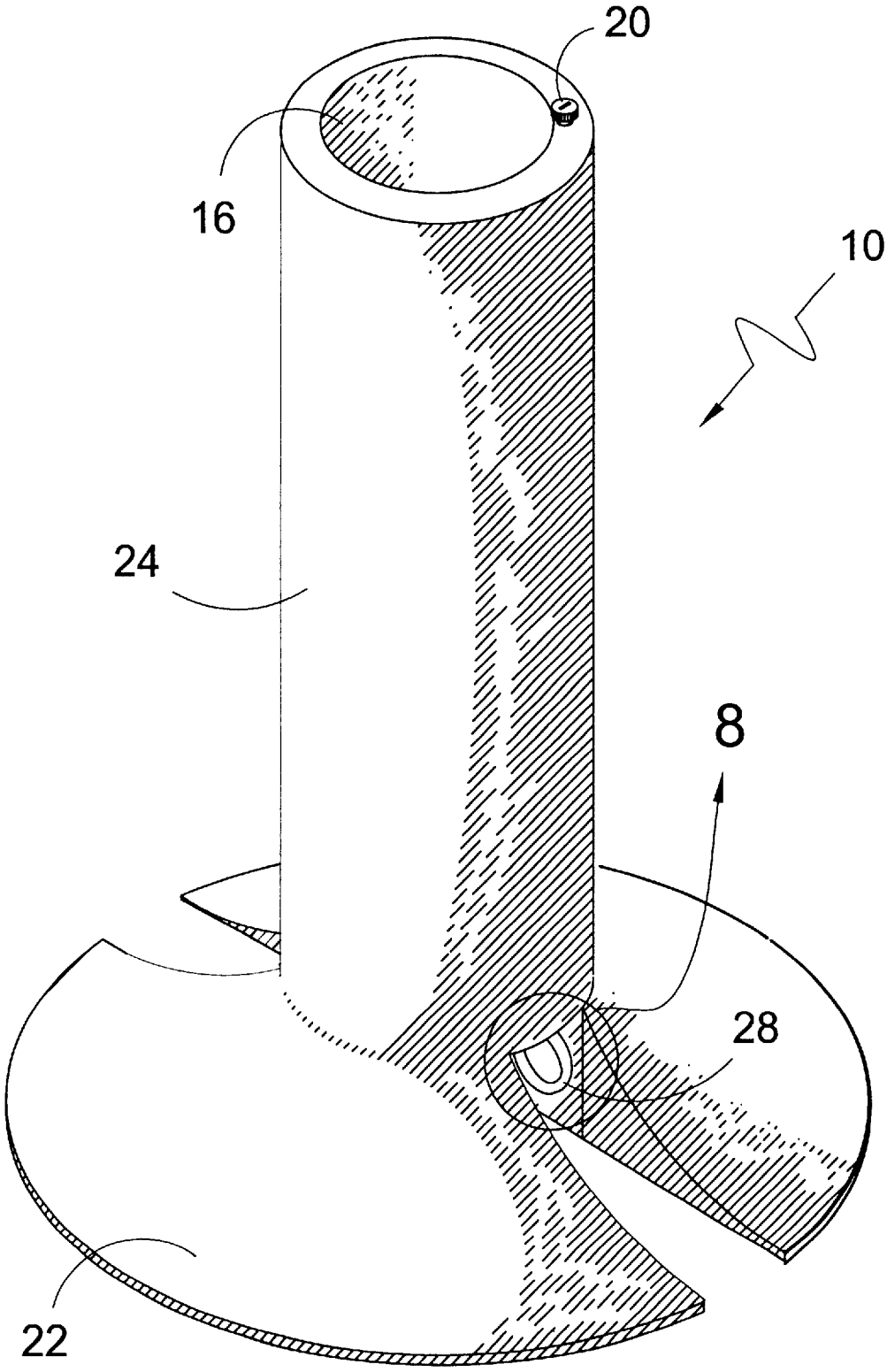
FIG. 4 is a perspective view of the present invention.

Turning to FIG. 4, shown therein is a perspective view of the present invention 10 which is an anchoring device for free standing structures. The device 10 has a centrally disposed throughbore 16 in sleeve 24 whereby a stanchion of the free standing structure can be inserted therein. The anchoring device 10 is substantially hollow with an ingress aperture and egress aperture with selective sealing means in the form of threaded fasteners, e.g., inlet cap 20. This provides for the filling of the cavity with a ballast material through the ingress aperture and the selective removal of the ballast through the egress aperture. Additionally, the anchoring device has a hook element 28 positioned on the enlarged base support 22 whereby a securing line such as a bungee cord can be secured.

Figure 5:
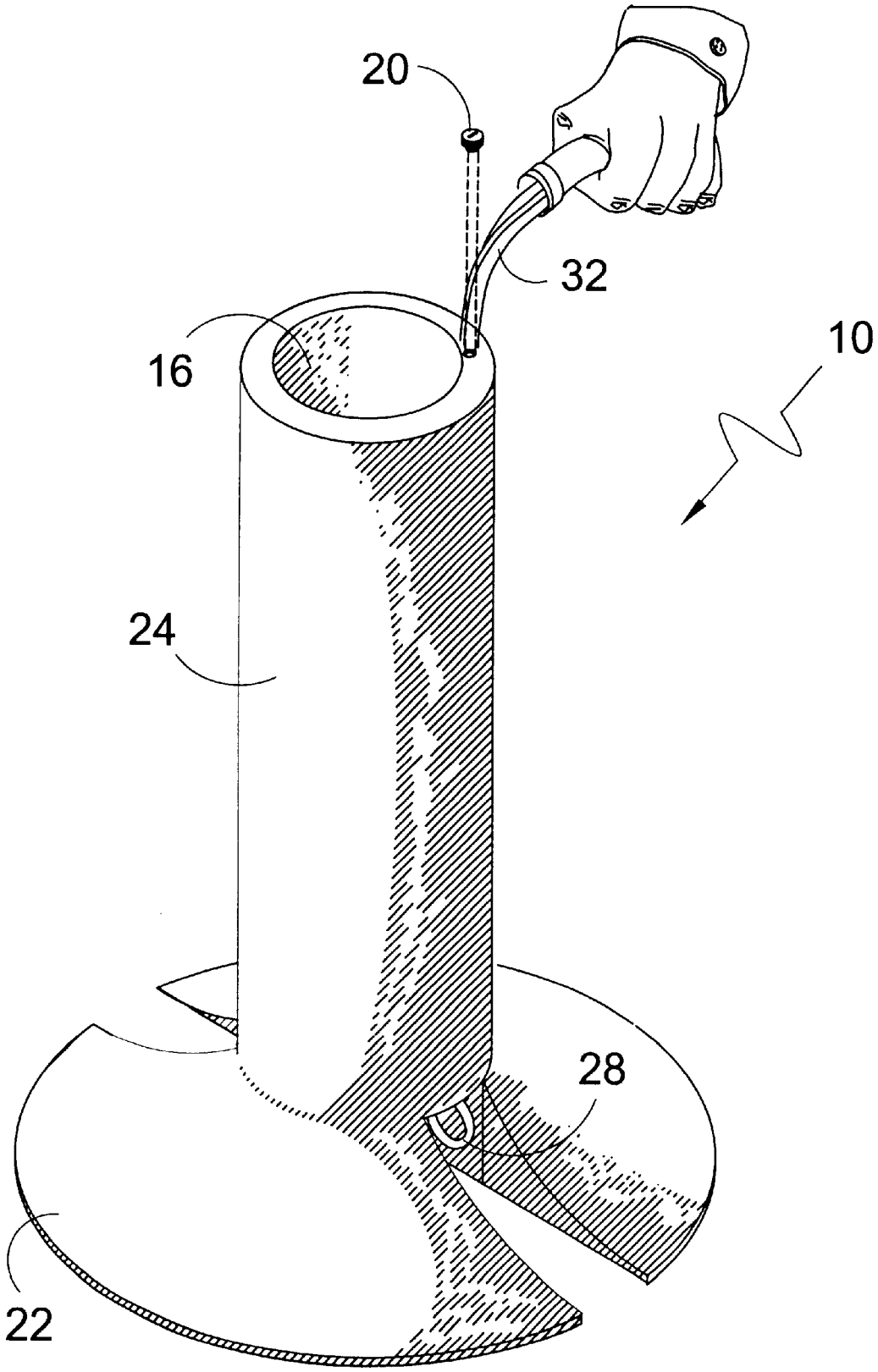
FIG. 5 is a perspective view of the present invention adding a ballast material.

Turning to FIG. 5, shown therein is a perspective view of the present invention 10 adding a ballast material 32. Shown is the present invention 10 having a sleeve 24 with centrally disposed throughbore 16 whereby a stanchion of a free standing structure can be inserted. The anchoring device 10 is substantially hollow whereby the cavity with cap 20 thereon can be filled with a ballast material 32. Additionally the anchoring device has a hook element 28 positioned on the base 22 whereby a securing line such as a bungee cord can be attached.

Figure 6:
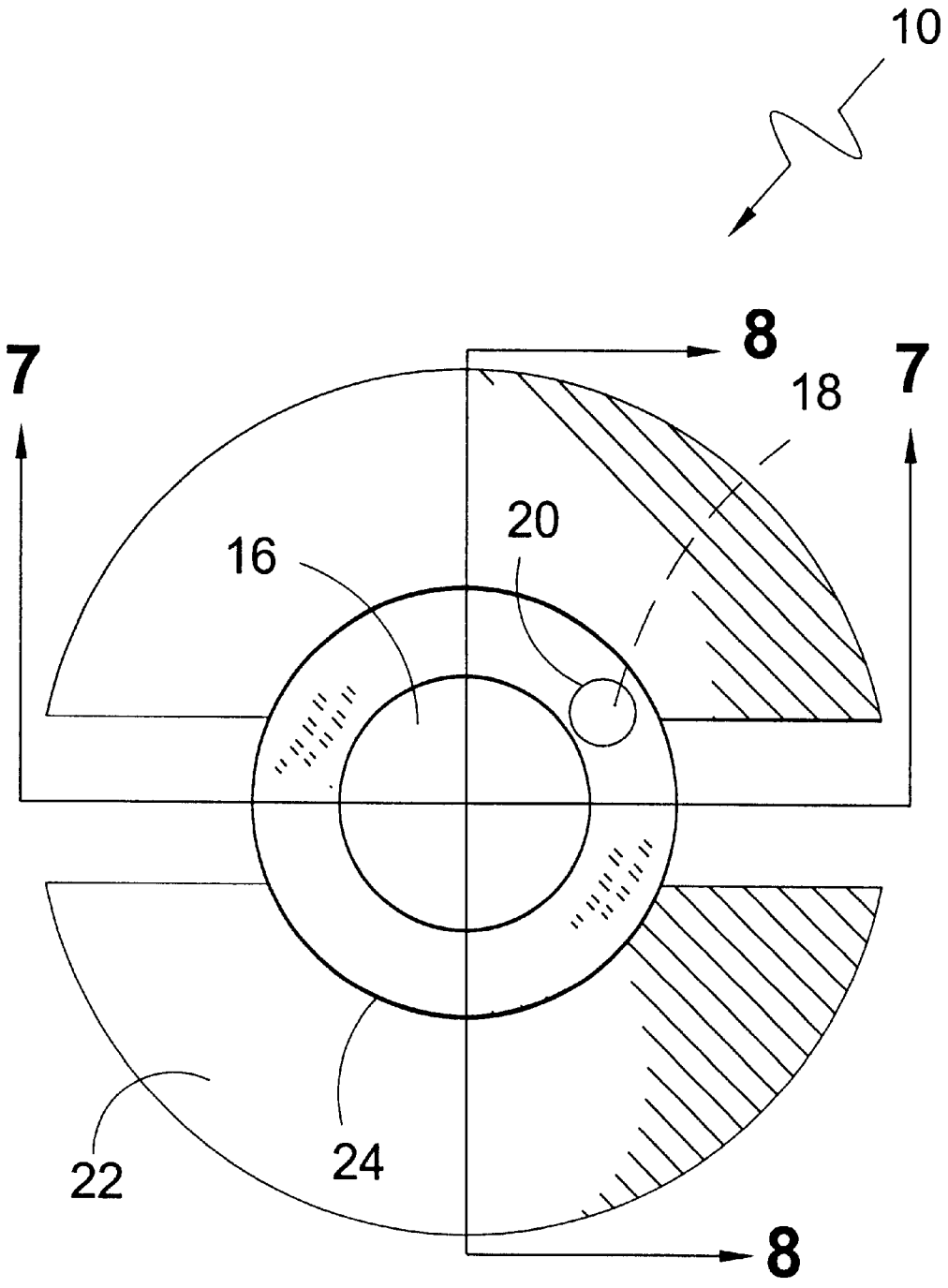
FIG. 6 is a top view of the present invention.

Turning to FIG. 6, shown therein is a top view of the present invention 10. Shown is a top view of the present invention being an anchoring device for free standing structures. The device 10 has a centrally disposed sleeve 24 with throughbore 16 whereby a stanchion of the free standing structure can be inserted. The anchoring device is substantially hollow with a fill port 18 with cap 20 for the filling of the cavity with a ballast material. The base support 22 is also shown.

Figure 7:
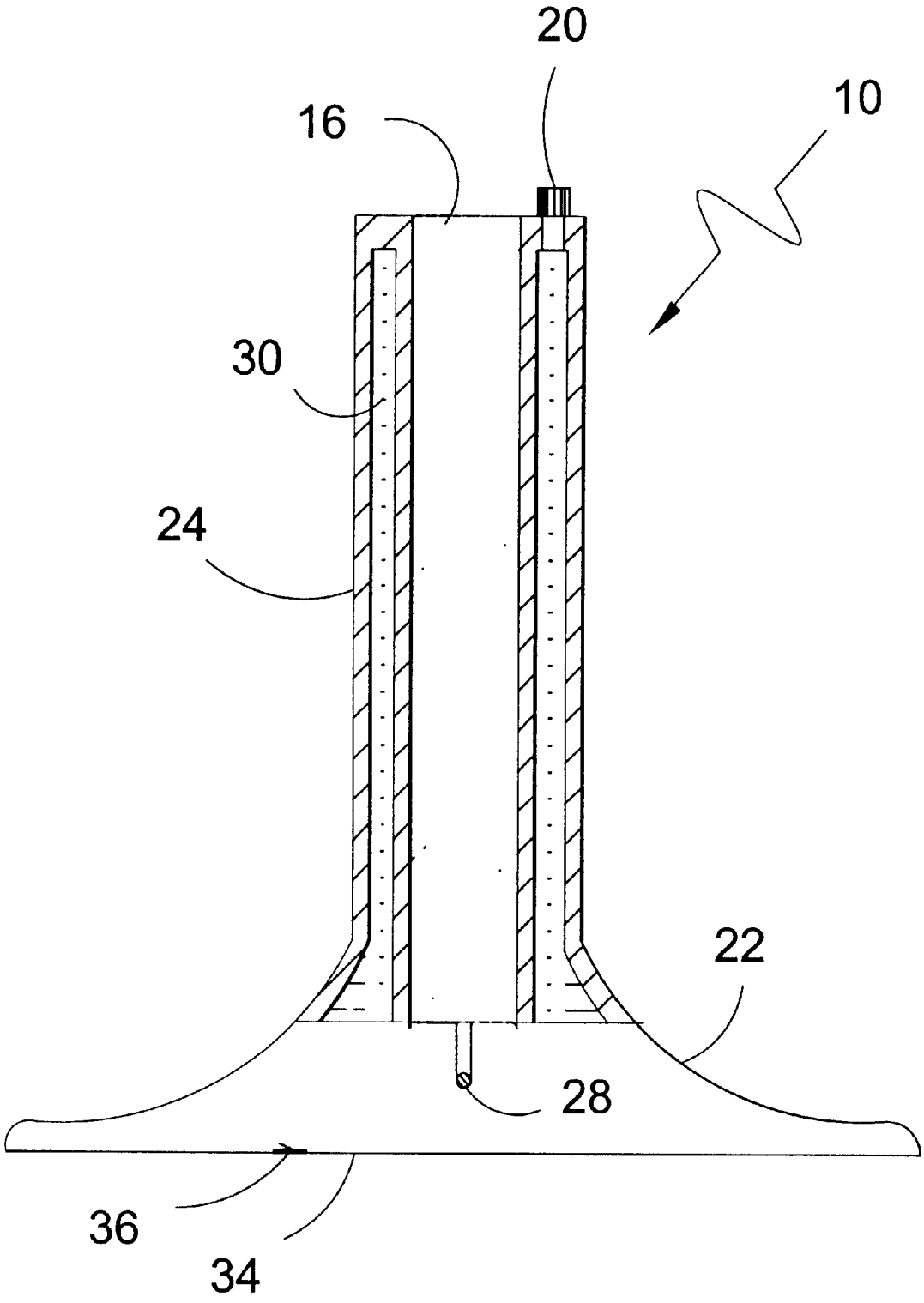
FIG. 7 is a cross sectional view of the present invention.

Turning to FIG. 7, shown therein is a cross sectional view of the present invention 10 being an anchoring device for free standing structures having a centrally disposed sleeve 24 with throughbore 16 whereby a stanchion can be inserted. The anchoring device is substantially hollow having a chamber 30 therein with an inlet aperture with cap 20 for inserting a ballast material and an outlet aperture 34 with cap 36 thereon for the removal of the ballast material. The anchoring device has a hook element 28 positioned on the base 22 whereby a securing line such as a bungee cord can be secured.

Figure 8:
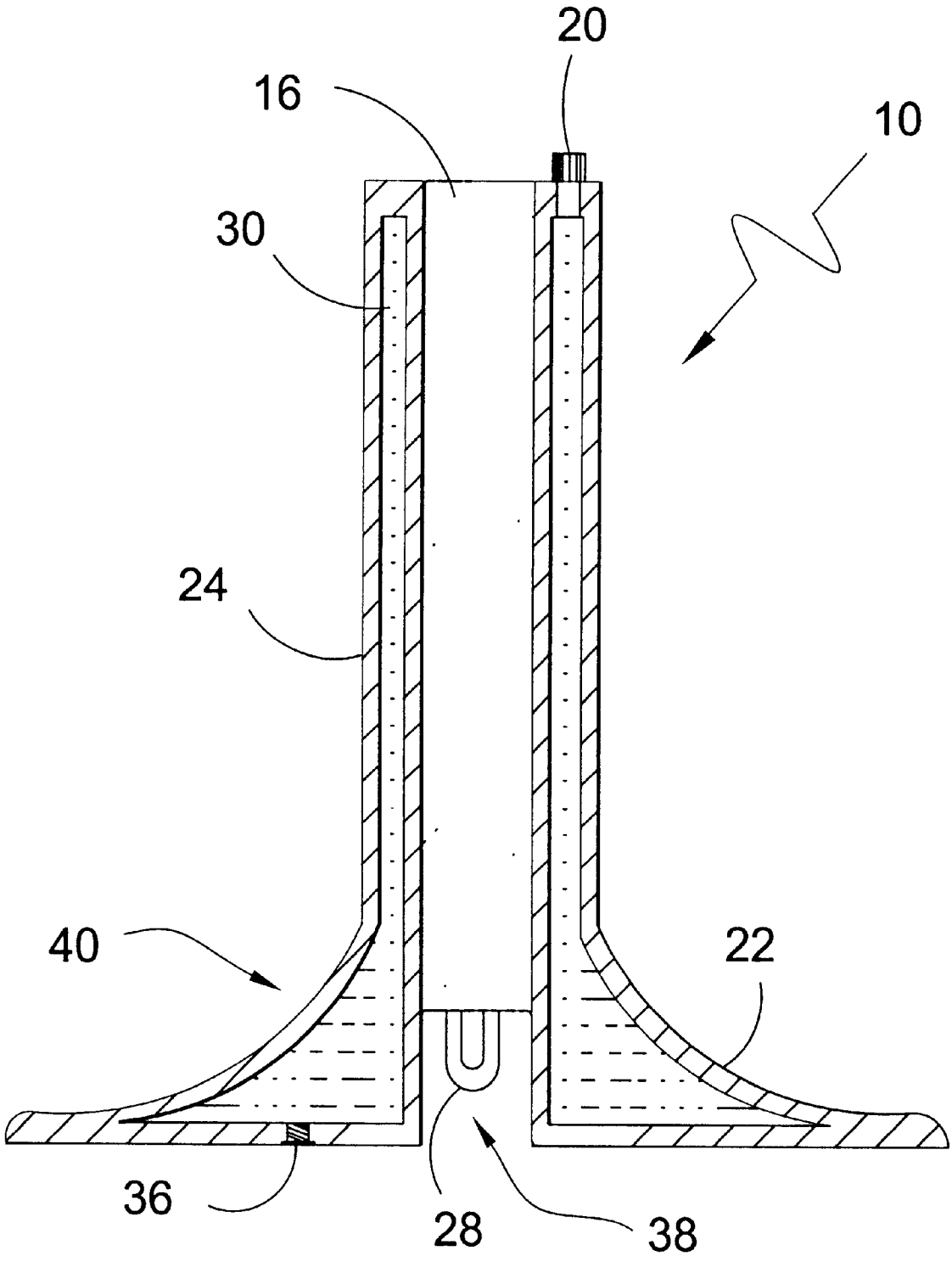
FIG. 8 is a cross sectional view of the present invention.

Turning to FIG. 8, shown therein is a cross sectional view of the present invention 10 being an anchoring device for free standing structures having a centrally disposed sleeve 24 with throughbore 16 whereby a stanchion can be inserted. The anchoring device is substantially hollow with chamber 30 therein which chamber extends into the wall and base 22 thereof with an inlet aperture and cap 20 for inserting a ballast material and an outlet aperture with cap 36 for the removal of the ballast material. The anchoring device has a hook element 28 positioned on the semi-circular base members 22 whereby a securing line such as a bungee cord can be secured. Base members 22 have a groove 38 thereinbetween wherein rests the ring 28 with the lower end of the sleeve 24 terminating near its juncture with the base 22. The base 22 is thickest at its center portion 40 and tapers peripherally toward its thin edges being flat on its bottom side.

Figure 9:
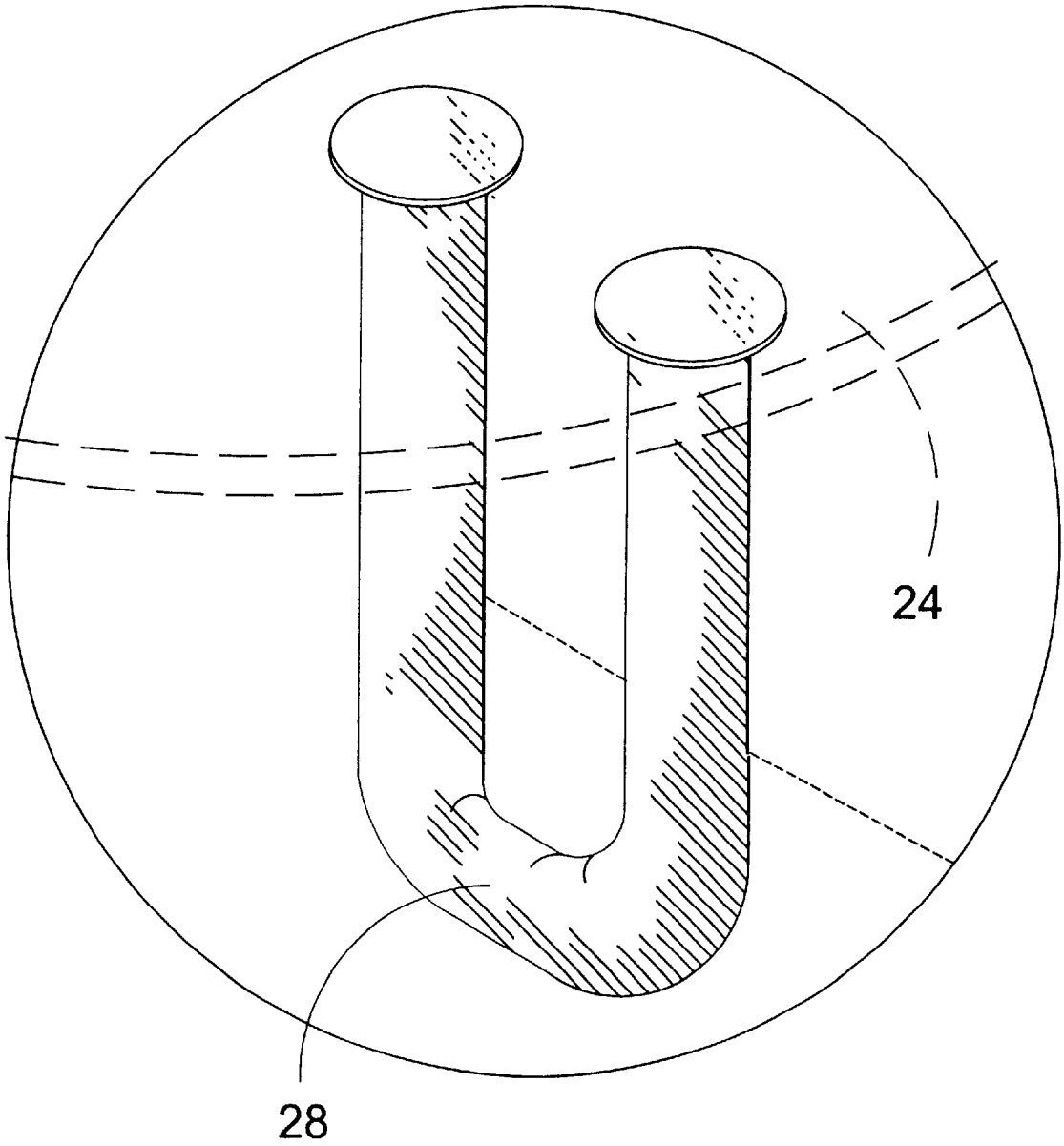
FIG. 9 is an enlarged view of the retaining ring.

Turning to FIG. 9, shown therein is an enlarged perspective view of the retaining ring 28. Shown is an enlarged view of the retaining ring 28 disposed in the wall of receiving sleeve 24 which ring 28 serves as an anchoring element for a strap that can be wrapped around or inserted through a portion, e.g., the end of the stanchion, of the device being anchored.

What is claimed to be new and desired to be protected by Letters Patent is set forth in the appended claims:

I claim:

1. An apparatus for receiving ballast material for anchoring a stanchion of a free standing structure, comprising:

a) an elongated cylindrical sleeve, said sleeve having a first upper end and a second lower end, said sleeve having a throughbore therein, said throughbore being open on each of said first and second ends, said sleeve having a cylindrical wall;

b) said wall having a cavity therein, said cavity for receiving ballast material;

c) an enlarged base disposed on said lower end of said sleeve, said base having a top side and a bottom side;

d) an inlet disposed on said sleeve whereby ballast material can be inserted therein;

e) an outlet disposed on said base whereby ballast material can be removed therefrom;

f) a securing ring disposed on said lower end of said sleeve whereby the stanchion can be secured thereon; and, g) a securing cord disposed on said securing ring whereby the stanchion can be secured therein.

2. The apparatus of claim 1, wherein said base has a cavity therein, said cavity for receiving ballast material, said cavity of said base communicating with said cavity of said wall.

3. The apparatus of claim 2, wherein said base further comprises a pair of spaced apart, semi-circular base members disposed on opposite walls of said sleeve having a groove thereinbetween.

4. The apparatus of claim 3, wherein said base members are thickest at their juncture with said sleeve, said lower end of said sleeve terminating at said juncture with said base member.

5. The apparatus of claim 4, wherein said top side of said base members taper from their centers peripherally toward their edges.

6. The apparatus of claim 5, wherein said base members are flat on said bottom side for contacting a support surface.

7. The apparatus of claim 6, wherein said inlet further comprises a first aperture disposed on said upper end of said sleeve, said first aperture having a removable cap thereon.

8. The apparatus of claim 6, wherein said first aperture is threaded and said cap for said first aperture is threaded, said threads of said cap mating with said threads of said first aperture.

9. The apparatus of claim 8, wherein said means for an outlet further comprises a second aperture disposed on said bottom side of said base, said second aperture having a removable cap thereon.

10. The apparatus of claim 9, wherein said second aperture is threaded and said cap for said second aperture is threaded, said threads of said cap mating with said threads of said second aperture.

11. The apparatus of claim 10, wherein said securing ring further comprises a downwardly extending ring, wherein said ring is embedded in said wall of said lower end of said sleeve.

12. The apparatus of claim 11, wherein said ring is disposed in said groove between said pair of base members.

13. The apparatus of claim 12, wherein said securing cord further comprises an elastic cord for being wrapped around the stanchion.

* * * * *